United States Patent [19]

Blackburn

[11] Patent Number: 4,507,642

[45] Date of Patent: Mar. 26, 1985

[54] SNAP-ACTING THERMALLY-RESPONSIVE BIMETALLIC ACTUATORS

[75] Inventor: Arthur M. Blackburn, Buxton, England

[73] Assignee: Otter Controls Limited, Buxton, England

[21] Appl. No.: 517,300

[22] Filed: Jul. 26, 1983

[30] Foreign Application Priority Data

Jul. 29, 1982 [GB] United Kingdom ..... 8221922

[51] Int. Cl.[3] ..... H01H 37/54

[52] U.S. Cl. ..... 337/89; 337/111; 337/365

[58] Field of Search ..... 337/36, 53, 85, 89, 337/111, 333, 343, 362, 365, 372, 379; 200/67 DA

[56] References Cited

U.S. PATENT DOCUMENTS 4,151,501 4/1979 Taylor ..... 337/372

*Primary Examiner*—Harold Broome

*Attorney, Agent, or Firm*—Pollock, Vande Sande & Priddy

[57] ABSTRACT

A snap-acting thermally-responsive actuator for an electric switch comprises a pear-shaped dished bimetallic blade having a U-shaped cut-out defining a tongue extending from its root or attached end at the larger end of the pear-shaped blade axially of the blade towards the smaller end of the blade, the tongue extending between outer leg portions of the blade which each have a width which decreases in a direction from the larger towards the smaller end of the blade. When the blade is mounted in a switch with the tip end of its tongue secured to a terminal part of the switch and with a moving switch contact carried on the smaller end of the blade for co-operation with a fixed switch contact secured to another terminal part of the switch, the blade thereby being susceptible to heating by electric current flow through the switch when the switch contacts are closed, the pear-shaped blade configuration coupled with the thinning of the outer legs towards the smaller end of the blade provides improved mechanical switching characteristics and improved self-heating characteristics in the blade leading to improved consistency of operation.

12 Claims, 4 Drawing Figures

SNAP-ACTING THERMALLY-RESPONSIVE BIMETALLIC ACTUATORS

FIELD OF THE INVENTION

This invention relates to snap-acting thermally-responsive bimetallic actuators for use in actuating the switch contacts of thermally responsive electric switches, for example, cut-outs, circuit breakers and thermostats.

BACKGROUND OF THE INVENTION

British Patent Specification No. 1,542,252 contains a discussion of the problems associated with the well known bimetallic actuator comprising a disc of domed configuration which moves to an oppositely domed configuration with a snap action with changes in temperature, such problems including drift of the operating temperature at which the disc snaps with age, a tendency for stress cracking to occur in the disc, and the very small range of useful movement associated with the snap action.

British Patent Specification No. 1,542,252 further discusses the also well known form of actuator described, for example, in British Patent Specification No. 657,434, which comprises a rectangular sheet or blade of bimetal having a central tongue released from between two outer legs whose ends, adjacent the free end of the tongue, are joined by a bridge portion, and wherein the blade has imparted thereto a dished configuration such that, with changes in temperature, the blade moves between oppositely dished configurations with a snap action. As described in British Patent Specification No. 657,434, the dished configuration was in the past imparted to the blade by virtue of a crimp being formed in the aforementioned bridge portion, but more recently the requisite dished configuration has been obtained by pressing the blade between two dies. The actuator of British Patent Specification No. 657,434 provides a much larger range of useful movement than the known disc actuator and is capable of being set to an accurately defined operating temperature, but has also been found to be susceptible to stress cracking.

The actuator of British Patent Specification No. 1,542,252 was designed particularly to overcome the stress cracking problems of the prior art, and in its preferred embodiment comprises a dished circular member of sheet bimetal having a curved aperture therein which, similarly to the actuator of British Patent Specification No. 657,434, releases a tongue from the bimetal member. The aperture has an outer periphery in the form of an arc of a circle which merges smoothly with the inner periphery of the aperture at rounded ends adjacent the root of the released tongue, this configuration having been designed to minimize stresses in the actuator when it snaps between its oppositely dished configurations. Reference may be made to British Patent Specification No. 1,542,252 for a full discussion of the problems associated with the prior art actuators and of the design considerations involved in the new actuator of British Patent Specification No. 1,542,252.

While the improved actuator of British Patent Specification No. 1,542,252 does have some advantageous features, it is unfortunately wasteful in material, and rectangular blade actuators of the general form described in British Patent Specification No. 657,434 continue to be widely used, particularly though not exclusively with the bimetal blade mounted by its center leg (i.e., its released tongue). It has been found that when such rectangular blade actuators are used as overload current sensing elements in circuit breakers, where the blade carries the current to be monitored and is responsive to the heating effect of such current flow, several problems are experienced.

The heating pattern in the bimetal blade is uneven and both ends of the blade tend to run cool, which gives rise to complex stresses in the bimetal. Furthermore, the end of the blade nearest the free or tip end of the released tongue, i.e., the end which would conventionally have taken a crimp for imparting the dished configuration to the blade, is quite broad and can itself snap at a different temperature from the other end of the blade nearest the root end of the released tongue, which is the end one would normally consider as constituting the snap action part of the bimetal; this effect is particularly marked at low temperatures (e.g., −40° C.) and, with the bimetal mounted by its central leg, has resulted in the larger end of the bimetal nearest the root end of the tongue snapping over center and the contacts of the switch nonetheless staying closed until the other (contact) end of the bimetal has snapped over at a different temperature.

SUMMARY OF THE INVENTION

The present invention provides a bimetal blade actuator generally similar to the actuator of British Patent Specification No. 657,434, but with the blade configured to provide a more consistent and uniform heating pattern under current, and with the contact end of the bimetal mechanically weakened so that it does not restrain the other end from snapping and opening the switch contacts. As will be appreciated from the following, the resultant blade has a generally "pear" shaped configuration.

More particularly stated, the present invention comprises a generally pear-shaped bimetallic blade which is stressed so as to be movable with temperature change between two oppositely dished configurations, a generally U-shaped cut-out in the blade releasing therefrom a tongue having a root or attached end adjacent the larger end of the pear-shaped blade and a tip or free end adjacent the smaller end, the tongue extending between two outer leg portions of the blade which each have a width decreasing in a direction from the larger towards the smaller end of the blade. The blade is preferably symmetrical on either side of an axis bisecting the tongue and, for minimizing the risk of stress fracture, the profiles both internal and external of the blade preferably are devoid of sharp angles and comprise only curved or curved and straight portions merging smoothly with each other.

BRIEF DESCRIPTION OF THE DRAWINGS

Further features and advantages of the invention will become apparent from consideration of the following description of preferred embodiments of the invention contrasted with a prior art bimetallic blade, as illustrated in the accompanying drawing, in which.

DETAILED DESCRIPTION

Figure 1:
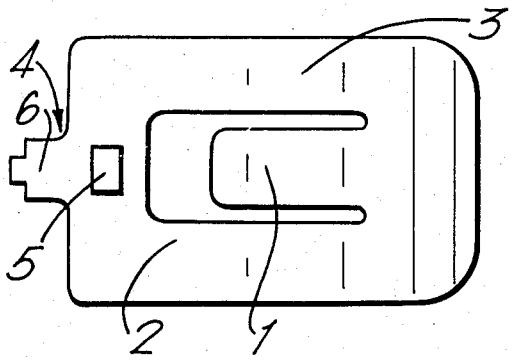
FIG.1. PRIOR ART
FIG. 1 shows a prior art rectangular bimetal blade.

Referring to FIG. 1, the bimetal blade shown therein is generally rectangular and has a central tongue 1 released therefrom, the tongue 1 extending between leg portions 2 and 3 which are connected adjacent the free end of the tongue 1 by a bridge portion 4. When the blade shown in FIG. 1 is mounted by its central tongue 1, the bridge portion 4 generally mounts the movable contact 5 of a switching contact pair. The blade of FIG. 1 is described in a typical application in our British Patent Application No. 8031960 (Specification No. 2,061,009 A) which concerns an electric switch incorporating such a blade as a snap-action thermally-responsive switch actuator, and with a latching member of the switch co-operating with an extension tab on the blade (corresponding to the tab 6 shown in FIG. 1) to prevent the switch once actuated from resetting until the latching action of the latching member is released; the tab 6 thus is not an essential part of a bimetal blade of this type and serves only a latching function. The blade of FIG. 1 is dished, as is well known in the art, and moves with a snap-action between two oppositely curved configurations with changes in temperature.

The bimetal blade of FIG. 1, while exhibiting advantageous characteristics as compared to other conventional forms of bimetal blade, nonetheless is susceptible to a number of problems which jointly and severally have prompted the present invention. For example, whereas bimetallic blades of the general type shown in FIG. 1 have performed adequately at higher ambient temperatures in a current carrying mode, at low ambient temperatures of the order of −30° C. to −40° C., for example, the working end of the blade (namely, the end adjacent the root of the tongue 1) has been observed to attempt to switch (i.e., to say to snap into its oppositely dished configuration) but to be restrained by the bridge portion 4. At best this could result in the blade switching at a slightly incorrect temperature, but at worst the consequence of this fault might be a double action switching of the blade with the working end of the blade going overcenter but not affecting the closed condition of the contacts until the bridge area of the blade reached its own snap temperature.

Another problem associated with the bimetal blade of FIG. 1 is that of uneven heating of the blade by electric current flowing through the blade from the tip of the released tongue 1 to the contact 5. It is not possible to have an absolutely constant current density throughout the blade, since this would require the tongue 1 to be twice as wide as the outer leg portions 2 and 3, which experience shows leads to the outer leg portions becoming too weak to contribute to the required snap action, so that the blade becomes inoperative. The relative thinness of the tongue 1 increases the current density therein, so that the tongue becomes the most heated part of the blade as regards current flow through the blade. To an extent this is not disadvantageous, and may even be beneficial, since the excess heating of the tongue contributes to the heating of the working part of the blade and thus to the responsiveness of the blade, and also causes the tongue to flex, so increasing contact pressure right up to the moment the blade snaps to its oppositely dished condition. However, the excess heating of the tongue has caused a temperature gradient to exist in the blade from the tongue 1 through the working portion and the outer leg portions 2 and 3 to the bridge portion 4 where heating of the blade has been poor, which has led to imprecision in the operation of the blade.

Figure 2:
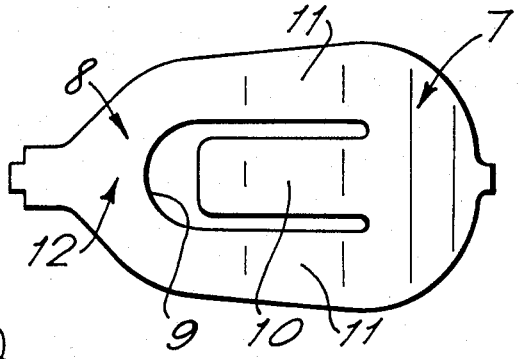
FIG. 2 shows a first pear shaped blade according to the present invention.
Figure 3:
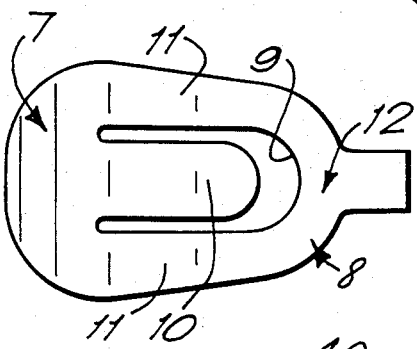
FIG. 3 shows a second pear shaped blade according to the present invention.

FIGS. 2 and 3 show pear shaped blades according to the invention wherein the bridge portion end of each blade is dimensionally reduced as compared with the other end so as to remove stiffness and ensure that it is the other end of the blade that dictates the blade switching characteristics. This pear shaped configuration has furthermore been found to produce more uniform heating of the blade by current flow therethrough.

It is to be noted that the blade of FIG. 2 is slightly differently shaped to the blade of FIG. 3. Variations are possible within the general "pear" shape of the blade, and the precise configuration selected for any particular application will depend upon the blade characteristics required. Broadly speaking, however, each of the blades of FIGS. 2 and 3 has a larger end 7 which constitutes the working end of the blade and a smaller end 8 which constitutes the normally contact-carrying end of the blade, a generally U-shaped cut-out 9 defining a tongue 10 between outer leg portions 11 which reduce in width from the larger to the smaller ends of the blade. As shown, the blades each are generally symmetrical about an axis bisecting their respective tongues and are profiled both internally, i.e., in the region of the U-shaped cut-out, and externally for avoidance of sharp transitions which might constitute centers for the initiation of stress fracture. The limbs of the U-shaped cut-out 9 are parallel in the embodiments of FIGS. 2 and 3, though the scope of the invention extends beyond such a construction.

It will be seen from FIGS. 2 and 3 that the bridge portion of the respective blades, i.e., portion designated 12, is substantially reduced dimensionally as compared to the other or working end of the blade, and the ends of the outer leg portions 11 where they merge into the bridge portion are also thinned down. It has been found that, by so designing the blade, the main problems associated with the prior art blade of FIG. 1 are largely overcome without loss of the excellent characteristics of that blade as regards its degree of operating movement. The combined mechanical and electrical effects of the design changes proposed in accordance with the present invention thus produce a bimetal blade having substantlally improved operating characteristics.

Figure 4:
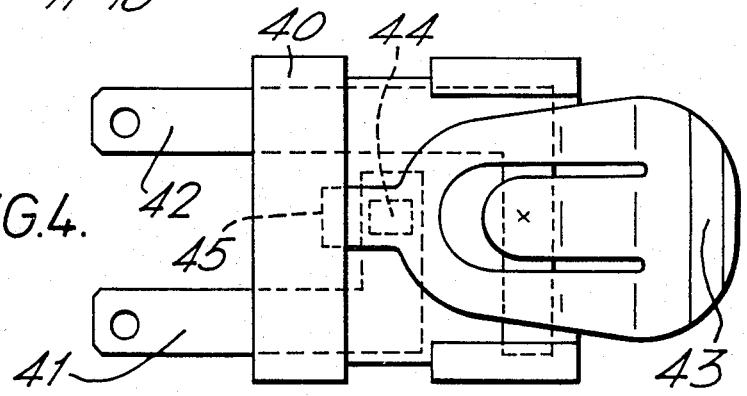
FIG. 4 shows an exemplary switch including the blade of FIG. 3.

FIG. 4 shows an exemplary form of thermostatic switch incorporating a bimetal blade of the type shown in FIG. 3. A molded plastic body part 40 has two brass terminal elements 41, 42 molded therein and defining mountings for a fixed contact of the switch and for the bimetal blade 43, respectively, the blade 43 being mounted by virtue of its tongue being spot welded or otherwise secured to a portion of terminal part 42. A movable contact is welded to the bridge portion of the blade for co-operation with the fixed contact of the switch, the position of the contacts being designated 44. In the switch in question, the tab portion 45 of the blade is not used with a latching mechanism, but instead simply co-operates with a back stop provided in the molded body part 40 to limit the switch opening movement of the blade and prevent it from being overstressed in the course of its snap-action operating movement.

I claim:

1. A snap-acting thermally-responsive bimetallic actuator for use in actuating the switch contacts of a thermally-responsive electric switch, the actuator comprising a generally pear-shaped bimetallic blade having a larger end portion, an opposite smaller end portion, and an intermediate portion of graded size extending between said larger and smaller end portions, said blade being stressed so as to be movable with temperature change between two oppositely dished configurations, and a generally U-shaped cut-out being provided principally in the intermediate portion of the blade so as to release therefrom a tongue having a root or attached end adjacent the larger end portion of the pear-shaped blade and a tip or fee end adjacent the smaller end portion, and the tongue extending between two outer leg portions of the intermediate portion of the blade which each have a width at the smaller end portion of the blade less than their width at the larger end portion of the blade.

2. An actuator according to claim 1, wherein the outer leg portions of the blade each have a width which decreases progressively in a direction from the larger end portion of the blade towards the smaller end portion of the blade.

3. An actuator according to claim 2, wherein the blade is symmetrical on either side of an axis bisecting the tongue.

4. An actuator according to claim 3, wherein the blade comprises internal and external profiles which are substantially devoid of sharp angles and comprise only curves or curves and straight lines merging smoothly with each other.

5. An actuator according to claim 4, wherein the stressing of the blade is provided by virtue of the blade having been die pressed so as to impart to the blade a dished configuration.

6. A thermally responsive electric switch comprising an actuator according to claim 5 arranged for actuating switch contacts of the switch, and wherein the free end of the tongue of the blade is mounted to a part of the switch and the smaller end portion of the blade is arranged to provide contacts operating movement of the switch.

7. A switch according to claim 6, wherein the free end of the tongue of the actuator blade is mounted to a first terminal part of the switch, a movable switch contact is mounted on the smaller end portion of the blade, and a fixed switch contact is mounted to a second terminal part of the switch, the fixed and movable contacts being arranged for cooperation with each other.

8. In a snap-acting thermally-responsive bimetallic actuator for a thermally-responsive electric switch, the actuator comprising a bimetallic blade having a first end portion, an intermediate portion, and a second opposite end portion, said intermediate portion having a generally U-shaped cut-out therein defining a tongue extending between outer leg portions of said intermediate portion, and said tongue having a root or attached end adjacent said first end portion of the blade and a tip or free end adjacent said second end portion of the blade, the said outer leg portions being continuous and integral with both the first and second end portions of the blade at both of their ends, and the blade being stressed so as to be movable between two oppositely dished configurations with a snap action in response to temperature change, the improvement comprising the blade being generally pear-shaped with said first end portion being larger than the second end portion of the blade, and the intermediate portion being of gradually diminishing size with said leg portions being thinner towards the second and smaller end portion of the blade than towards the first and larger end portion of the blade, whereby the larger end portion of the blade is predominantly responsible for temperature sensitive snap-action movement of the blade to its oppositely dished configuration and is not significantly constrained in such action by the mechanical coupling with the smaller end of the blade, and whereby current flow patterns in the blade between the free end of the tongue and the second end portion of the blade produce a current density in said leg portions which increases towards said second end portion of the blade.

9. In a thermally responsive switch comprising an electrically insulating body portion, first and second electrically conductive terminal parts secured in said body portion, a bimetallic blade having a generally U-shaped cut-out therein releasing from an intermediate portion of the blade a tongue extending between outer leg portions connected at their ends to first and second end portions of the blade which are respectively adjacent the root (attached) end of the tongue and the tip (free) end of the tongue, the tip end of the tongue being secured to said first terminal part for mounting the blade in the switch, the second end portion of the blade carrying a moving contact of the switch, a fixed contact of the switch being provided in said second terminal part for cooperation with said movable contact, and the blade being stressed so as to be movable with a snap-action between two oppositely dished configurations for operating the switch in response to temperature change, the improvement comprising said blade being generally pear-shaped with a larger end portion constituting said first end portion, a smaller end portion constituting said second end portion, and an intermediate portion graded in size between said larger and smaller end portions, said outer leg portions being thinner adjacent the smaller end portion of the blade than adjacent the larger end portion, whereby the smaller end portion of the blade does not constitute any substantial mechanical restraint upon snap-acting movement of the blade initiated by its larger end portion, and current flow between said terminal parts through the blade produces a current density in said leg portions which is greatest towards the smaller end portion of the blade.

10. A thermally responsive electric switch comprising switch contacts and a snap-acting thermally-responsive bimetallic actuator arranged for operating said switch contacts, said snap-acting thermally-responsive bimetallic actuator comprising a generally pear-shaped bimetallic blade having a larger end portion, an opposite smaller end portion, and an intermediate portion of graded size extending between said larger and smaller end portions, said blade being stressed so as to be movable with temperature change between two oppositely dished configurations, and a generally U-shaped cut-out being provided principally in the intermediate portion of the blade so as to release therefrom a tongue having a root or attached end adjacent the larger end portion of the pear-shaped blade and a tip or free end adjacent the smaller end portion, and the tongue extending between two outer leg portions of the intermediate portion of the blade which each have a width at the smaller end portion of the blade lesser than their width at the larger end portion of the blade, the free end of said tongue being mounted to a blade mounting part of the switch and the smaller end portion of the blade being arranged to provide the contacts operating movement of the switch.

11. A thermally responsive electric switch according to claim 10, wherein the free end of the tongue of the actuator blade is mounted to a first terminal part of the switch, a movable switch contact is mounted on the smaller end portion of the blade, and a fixed switch contact is mounted to a second terminal part of the switch, the fixed and movable contacts being arranged for cooperation with each other.

12. A thermally responsive electric switch according to claim 11, wherein said blade further comprises a tab portion extending outwardly of the second smaller end portion of the blade for cooperation with a back stop provided in the switch to limit the switch-opening movement of the blade.

* * * * *